US006742262B2

(12) United States Patent
Rizzuto, Jr. et al.

(10) Patent No.: US 6,742,262 B2
(45) Date of Patent: Jun. 1, 2004

(54) DETACHABLE AND ADJUSTABLE BLADE ASSEMBLY

(75) Inventors: Leandro P. Rizzuto, Jr., Sheridan, WY (US); Kam Fai Fung, Hong Kong (CN); Brenda P. K. Yue, Hong Kong (CN)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 10/094,145

(22) Filed: Mar. 8, 2002

(65) Prior Publication Data

US 2003/0005585 A1 Jan. 9, 2003

Related U.S. Application Data

(60) Provisional application No. 60/282,558, filed on Apr. 9, 2001.

(51) Int. Cl.[7] ..... B26B 19/20
(52) U.S. Cl. ..... 30/201
(58) Field of Search ..... 30/200, 201, 43.1, 30/202, 223, 224

(56) References Cited

U.S. PATENT DOCUMENTS

| | | | | |
|---|---|---|---|---|
| 2,182,597 | A | 12/1939 | Oster | |
| 2,928,171 | A | 3/1960 | Oster | |
| 3,659,180 | A | 4/1972 | Urbush | |
| 3,747,212 | A | 7/1973 | Krayl | |
| 4,458,417 | A | 7/1984 | Andis | |
| 4,571,830 | A | 2/1986 | Kassner et al. | |
| 4,679,322 | A | 7/1987 | Hunts | |
| 4,776,095 | A | 10/1988 | Tsujimoto et al. | |
| 4,989,324 | A | 2/1991 | Andis | |
| 5,123,159 | A | 6/1992 | Kubo et al. | |
| 5,165,172 | A | 11/1992 | Weinrauch | |
| 5,325,589 | A | 7/1994 | Kubo | |
| 5,367,772 | A | 11/1994 | Ogawa | |
| 5,386,634 | A | 2/1995 | Ogle et al. | |
| 6,260,276 | B1 * | 7/2001 | Lebherz et al. | 30/201 |

* cited by examiner

*Primary Examiner*—Douglas D. Watts
(74) *Attorney, Agent, or Firm*—Ohlandt, Greeley, Ruggiero & Perle, LLP

(57) ABSTRACT

There is provided a blade assembly having a stationary comb or blade and a recepricating cutter. The blade Assembly permits for adjustment over a range of cut lengths and detachability/convertability to a range of hair clippers.

15 Claims, 4 Drawing Sheets

DETACHABLE AND ADJUSTABLE BLADE ASSEMBLY

This application claims the benefit of Provisional Application No. 60/282,558, filed Apr. 9, 2001.

BACKGROUND OF THE INVENTION

1. Field of the Invention

The present invention relates to a hair clipper. More particularly, the present invention relates to a hair clipper having an improved blade assembly. The blade assembly provides for adjustability over a range of cut lengths and detachability over a range of hair clippers.

2. Description of the Prior Art

Hair clippers with the ability to vary cut length capability have been known. For example, U.S. Pat. No. 5,325,589 provides a hair clipper having a movable blade that is moved relatively to an adjuster handle mounted on the housing of the clipper. The movable blade can be moved in the rearward direction along the longitudinal axis to reduce the cut length when the adjuster handle is moved in the forward direction along the longitudinal axis. U.S. Pat. No. 5,367,772 provides an adjuster handle that is slidably fitted on an outer round surface of the housing and linked to the movable blade through a linkage member. The movable blade is shifted in the edgewise direction to increase and reduce the cut length by rotating the adjuster handle about a longitudinal axis of the housing.

It is also known to provide a hair clipper having a blade assembly that can be detachably mounted to the clipper. Two examples of detachable blade assemblies for a hair clipper are illustrated in U.S. Pat. Nos. 2,182,597 and 2,928,171. These patents illustrate blade assemblies that include a tongue-receiving socket for mounting the assembly on an associated support tongue. Further, U.S. Pat. No. 5,092,048 provides means for allowing the tongue-receiving socket to be detachably connected with various support tongues having different configurations to enable assorted blade assemblies to be combined and used with a single clipper.

None of the above provide for a blade assembly that is both adjustable over a range of cutting lengths and interchangeable between different hair clippers. For example, specific blades, given their relative size and physical characteristics, are required to obtain a specific desired cut. None of the above-identified clippers provide an operator with the needed versatility associated with a uniform blade assembly having both adjustable and detachable qualities.

SUMMARY OF THE INVENTION

It is an object of the present invention to provide a hair clipper that has an adjustable blade assembly.

It is another object of the present invention to provide such a hair clipper in which the adjustable blade assembly can be used interchangeably with any clipper having a similar engagement configuration.

It is still another object of the present invention to provide such a hair clipper in which the blade assembly has greater flexibility and versatility in the type and size of blades that can be used in conjunction with the hair clipper.

These and other objects and advantages of the present invention are covered by a blade assembly for a hair clipper that has a pocket type structure, and a blade assembly that includes a stationary comb blade and a cutter blade. The blade assembly is adapted to be secured to the pocket type structure. The pocket type structure or pocket includes a bracket for detachably securing the blade assembly to the clipper. In a preferred embodiment, the cutter blade is connected to a mounting plate along through holes therein. The comb blade has through holes therein, which are adapted to receive blade screws. The blade screws extend through the holes and are threadably engaged with the pocket through the holes in the mounting plate. The mounting plate permits the cutting blade to reciprocate, and biases the cutting blade towards the comb blade by a set of coil springs positioned between the mounting plate and the pocket.

The blade assembly is adjusted by positioning the front edge of the comb blade closer or farther from the front edge of the cutter blade. A control lever is secured to an end of an actuator that extends through the pocket. Thus, rotation of the actuator, via the control lever, causes the mounting plate and/or a guide disposed on the cutter blade to urge the front edges of the cutter blade and the comb blade toward and/or away from each other.

Thus, the present invention to provide an improved hair clipper that is capable of facilitating hair shearing to a desired length in a convenient and versatile manner, while at the same time ensuring ease of use.

DETAILED DESCRIPTION OF THE INVENTION

Figure 1:
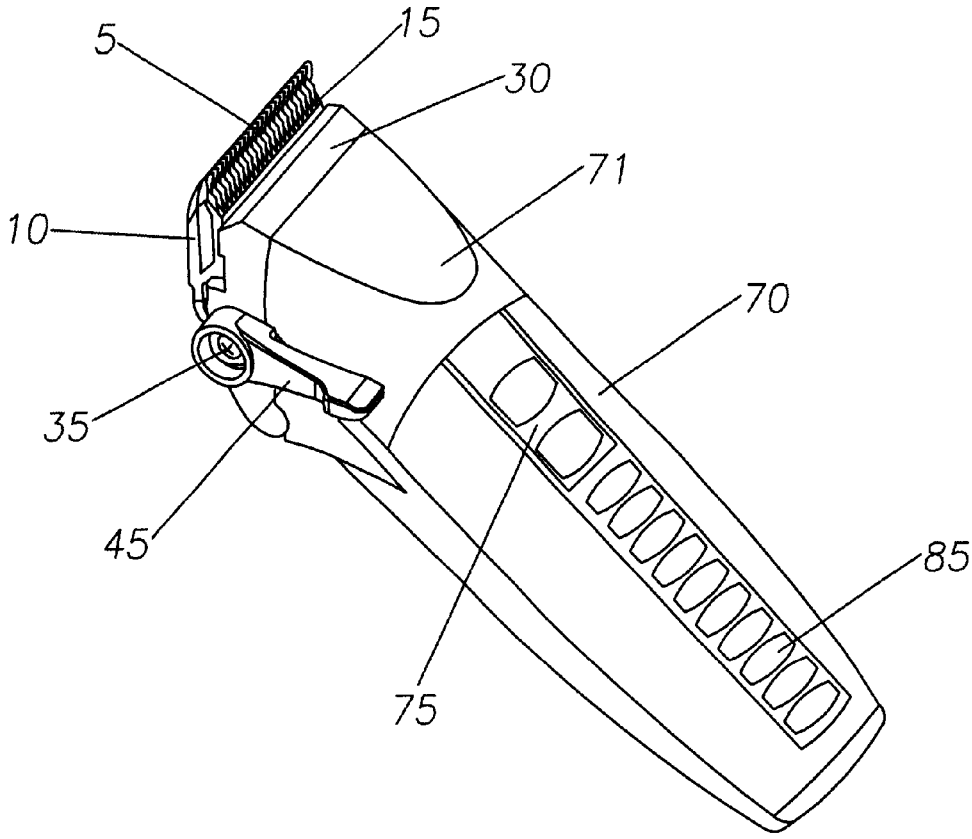
FIG. 1 is a perspective view of a hair clipper, in accordance with a preferred embodiment of the present invention.
Figure 2:
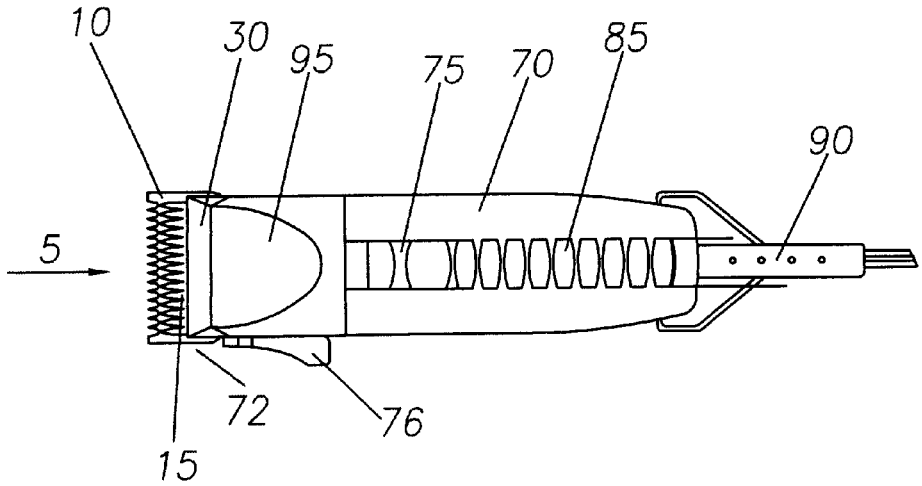
FIG. 2 is a top view of the hair clipper of FIG. 1.

Referring to the drawings and, in particular, FIG. 1, there is shown a hair clipper in accordance with a preferred embodiment of the present invention generally represented by reference numeral 1. The clipper 1 has a housing 70, and a motor (not shown) located in the housing and having a device or driving mechanism (not shown) through which a driving lever 26, shown in FIG. 3, oscillates, and an electrical connector 90 for activating the motor. The motor and driver can be any conventional driver known for use in a hair clipper. The motor is constructed, preferably, of an electrically insulated material, such as plastic. Housing 70 can preferably be made of metal or plastic. Housing 70 has a user operating switch 75 for turning the motor "on" and "off", a support tongue 100 having a bracket 105, shown in FIG. 5, preferably integrally formed to enable the support tongue to be pivotally mounted and supported on a front end of the housing. Housing 70 preferably also has a plurality of first grippers or grip structures 85 on one face and, also preferably has a plurality of second grippers or grip structures 80 on its opposite face.

Figure 3:
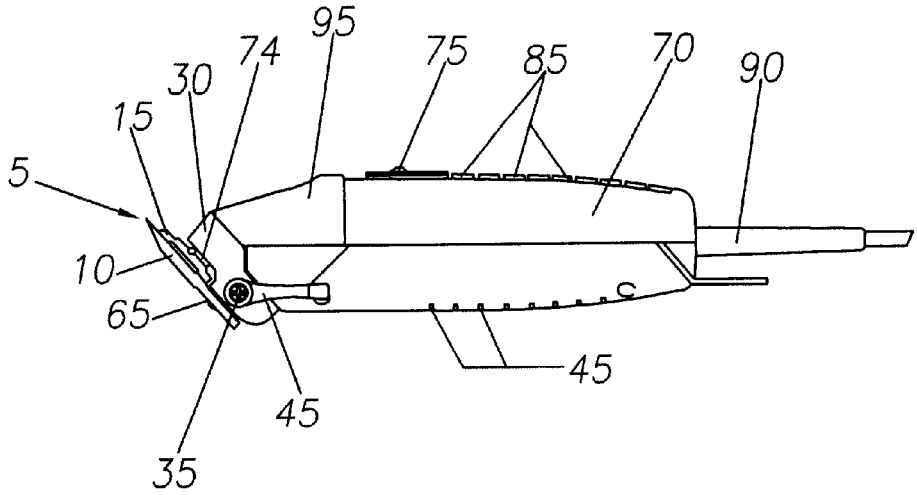
FIG. 3 is a side view of the hair clipper FIG. 1.
Figure 4:
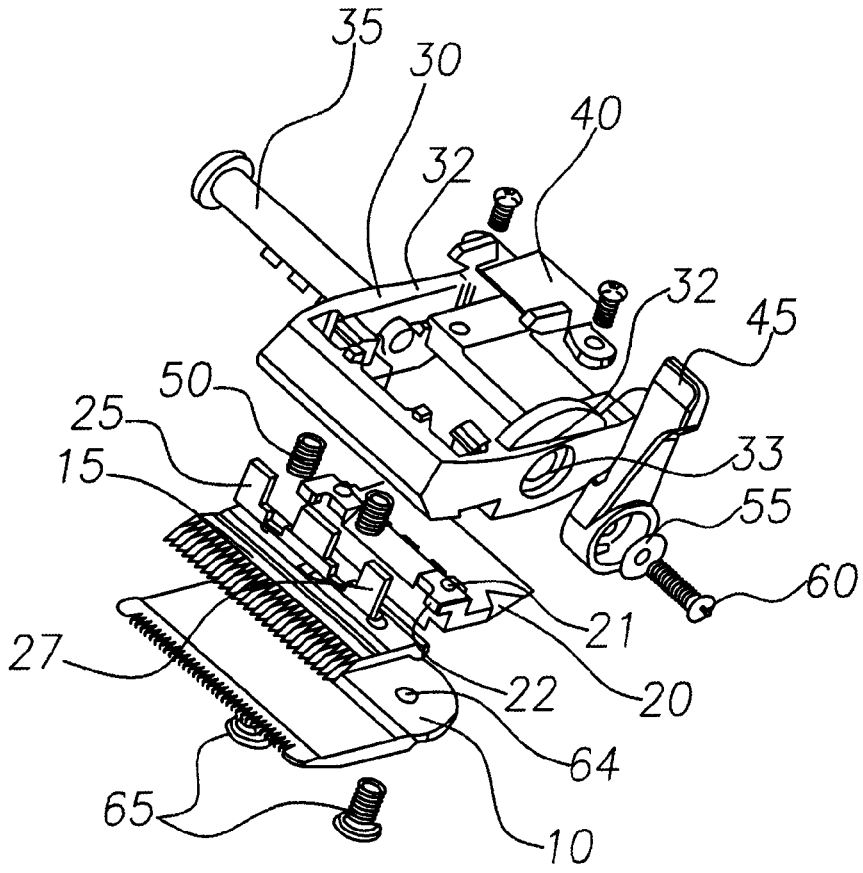
FIG. 4 is an exploded view of the blade assembly of FIG. 4.

Referring to FIG. 4, housing 70 is adapted to receive a front end structure or pocket 30 for receipt of a blade assembly 5. Pocket 30 has a U-shaped structure with a pair of opposed walls 32 having apertures 33 therein, shown more clearly in FIG. 4. Apertures 33 are sized to receive a rod or actuator 35. Rod 35 is connected at one end to a control lever 45. Referring to FIG. 3, housing 70 preferably has a planar structure 95 for covering oscillator and drive assembly. Housing 70 also has at front or forward end 72, and a drive lever 74 that projects from the housing to enable operative engagement with a guide 25 shown in FIG. 4.

Figure 5:
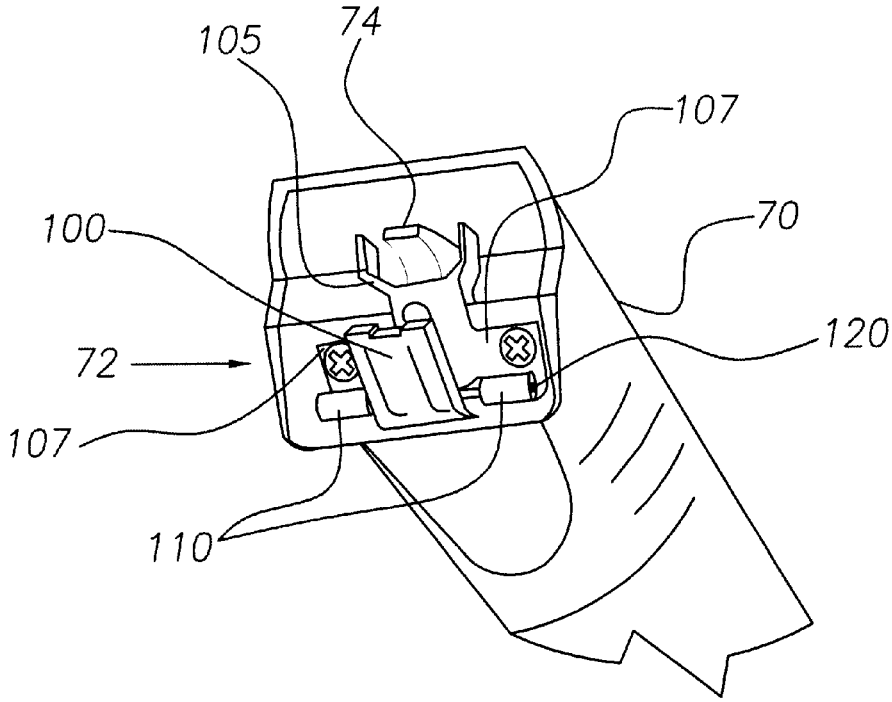
FIG. 5 is a perspective view of the bracket and tongue support assembly of the hair clipper of FIG. 1.

Referring to FIG. 5, bracket 105 has a pair of laterally spaced arms 107 that have curled ends to form a pair of hinge loops 110, and a middle portion of the bracket extending outwardly from the inclined front end 72 of the clipper housing 70. Hinge loops 110 having an aperture in each loop separately spaced for receiving a hinge pin 120. Hinge pin 120 extends through the aperture in each pair of hinge loops 110 to hingedly mount support tongue 100 on housing 70. Tongue 100 is pivotable from an open position shown in FIG. 5 in which the tongue 100 extends in a forward direction away from housing 70, to a closed position (not shown) in which the tongue 100 lies against a middle portion of the bracket 105 on the front end 72 of the housing 70. A spring or the like (not shown) is connected, preferably fixed, to the underside of bracket 105 that engages support tongue 100 and holds the support tongue in either the open or closed position.

Referring to the preferred embodiment of FIG. 4, pocket 30 includes a bracket 40 for detachably securing blade assembly 5 to housing 70. Bracket 40 is preferably metal. Blade assembly 5 has a guide 25, a stationary comb blade 10 and a cutter or cutting blade 15 that is connected to guide 25 and adapted to be positioned adjacent the comb blade 10. Blade assembly 5 also has a mounting plate 20. Mounting plate 20 has a series of recesses 22 and on or more, preferably two through holes 21. Preferably, blades 10 and 15 are made of steel. Guide 25 is engageably connected (not shown) to driving lever 26 that extends from the motor in housing 70. Guide plate 25 has a plurality of vertical posts 27 positioned approximately ninety degrees with respect to the teeth of comb blade 10 and cutter blade 15. Posts 27 are adapted to mate with recessed 22 of mounting plate 20.

Comb blade 10 has one or more, preferably two, through holes 64 therein, that are adapted to receive a corresponding number of blade screws 65. Blade screws 65 extend through holes 64 of comb blade 10 through holes 21 in mounting plate 20 and engage pocket 30. Mounting plate 20 permits cutting blade 15 to reciprocate, and biases the cutting blade 15 towards comb blade 10 by a set of coil springs 50 Positioned between guide 25 and mounting plate 20. A control lever 45, that is preferably tapered, is secured to the end of an actuator 35. Actuator 35 extends through aperture 33 in pocket 30 and is connected to the pocket by a washer 55 and screw a 60. Screw 60 fits in an aperture of control lever 45 and is secured to an end of actuator 35. Rotation of actuator 35, via control lever 45, causes mounting plate 20 and/or guide 25 to urge the front edges of cutter blade 15 and comb blade 10 toward and/or away from each other. This adjusts the distance between comb blade 10 and cutter blade 15 and, thus, adjusts the length or depth of cut.

Figure 6:
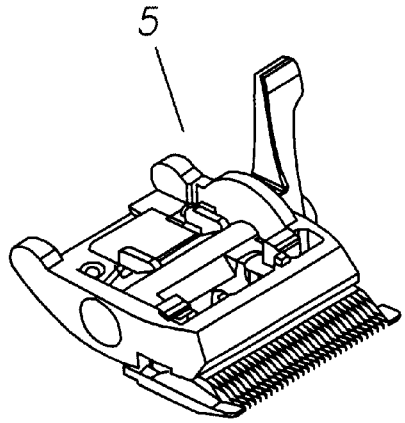
FIG. 6 is a perspective view inverted and rotated ninety degrees of the blade assembly of the hair clipper of FIG. 1.

Referring now to FIG. 6, blade assembly 5 is shown assembled to pocket 30. The blade assembly 5 and pocket 30 are ready to be affixed onto clipper 1.

As described in detail in the foregoing, blade assembly 5 and pocket 30 provide an assembly for many clippers in which an operator greater flexibility in the cut lengths that can be made by the clipper. In addition, blade assembly 5 provides a greater versatility of use, as it is capable of being operably connected to a variety of different clippers that have a complementary receiving structure.

What is claimed is:

1. A hair clipper comprising:

a body with a tongue structure pivotally mounted to and supported by said body;

a blade assembly detachably securable to said body and having at least a stationary blade and a reciprocating blade, each blade having a cutting edge;

an actuator; and a control lever operatively connected to said actuator, wherein when said control lever is rotated, said actuator causes said cutting edge of said reciprocating blade to move relative to said cutting edge of said stationary blade so as to allow the hair cutting length to be adjusted, wherein said blade assembly has a pocket structure with a bracket for selectively and detachably engaging said tongue structure and thereby enabling said blade assembly to be detachably secured to said body.

2. The hair clipper of claim 1, wherein said body encloses a motor operatively connected to said blade assembly by a driving member.

3. The hair clipper of claim 1, wherein said actuator is a rod operatively connected with said pocket structure.

4. A blade assembly for releasable engagement with a hair clipper, said blade assembly comprising:

a stationary blade;

a reciprocating blade positioned adjacent said stationary blade;

a guide structure;

a mounting structure operatively connecting said guide structure and said reciprocating blade; and a U-shaped pocket structure having a bracket for selectively engaging a tongue, wherein said tongue is pivotally mounted to said hair clipper.

5. The blade assembly of claim 4, wherein said stationary blade has a first cutting edge.

6. The blade assembly of claim 5, wherein said reciprocating blade has a second cutting edge.

7. The blade assembly of claim 6, further comprising an actuator.

8. The blade assembly of claim 4, wherein said actuator has a control lever operatively connected thereto.

9. The blade assembly of claim 8, wherein when said control lever is rotated, said actuator causes said second cutting edge of said reciprocating blade to move relative to said first cutting edge of said stationary blade so as to allow the hair cutting length to be adjusted.

10. The blade assembly of claim 4, wherein said guide structure is selectively and operatively connectable to a driving member coupled to a motor within said hair clipper.

11. An adjustable blade assembly for a hair clipper comprising:

a stationary blade with a first cutting edge;

a reciprocating blade positioned adjacent said stationary blade and having a second cutting edge;

a U-shaped pocket structure with a pair of opposed walls having apertures therein for receiving an actuating rod; and a control lever operatively connected to said actuating rod, wherein when said control lever is rotated, said actuating rod causes said second cutting edge of said reciprocating blade to move relative to said first cutting edge of said stationary blade so as to allow the hair cutting length to be adjusted.

12. The blade assembly of claim 11, further comprising a guide selectively and operatively connectable to a driving member coupled to a motor within said hair clipper.

13. The blade assembly of claim 12, wherein said guide and said reciprocating blade are operatively connected by a mounting structure.

14. The blade assembly of claim 11, wherein said U-shaped pocket structure has a bracket adapted to selectively engage a tongue.

15. The blade assembly of claim 14, wherein said tongue is pivotally mounted to said hair clipper.

* * * * *